US008468713B2

(12) United States Patent
Evans

(10) Patent No.: US 8,468,713 B2
(45) Date of Patent: Jun. 25, 2013

(54) CONTACT LENS CASE DRYING AND STORAGE RACK ASSEMBLY

(76) Inventor: Karen Marie Evans, Gilbert, AZ (US)

( * ) Notice: Subject to any disclaimer, the term of this patent is extended or adjusted under 35 U.S.C. 154(b) by 521 days.

(21) Appl. No.: 12/861,699

(22) Filed: Aug. 23, 2010

(65) Prior Publication Data

US 2012/0042533 A1 Feb. 23, 2012

(51) Int. Cl.
*F26B 25/18* (2006.01)

(52) U.S. Cl.
USPC ..... 34/239; 211/85.1

(58) Field of Classification Search
USPC ..... 34/511, 237, 239; 211/13.1, 85.1; 248/309.1; 206/5.1
See application file for complete search history.

(56) References Cited

U.S. PATENT DOCUMENTS 3,124,240 A * 3/1964 Croan ..... 206/5.1
3,623,492 A 11/1971 Frantz
D338,217 S 8/1993 Ives
D530,430 S 10/2006 Dunbar
7,458,470 B2 12/2008 Jerstroem
2007/0125725 A1 6/2007 Kemper et al.
2009/0065375 A1 3/2009 Winters et al.

FOREIGN PATENT DOCUMENTS

JP 02004298564 A 10/2004

* cited by examiner

*Primary Examiner* — Jiping Lu
(74) *Attorney, Agent, or Firm* — Parsons & Goltry; Michael W. Goltry; Robert A. Parsons

(57) ABSTRACT

A drying rack and contact lens storage case assembly consists of a contact lens storage case assembly that includes a base formed with externally threaded receptacles having inner diameters, and internally threaded caps having inner diameters and which relate to the respective receptacles. A drying frame is formed with patterns of protuberances relating to inner diameters of the receptacles formed in the base and the caps, respectively. The receptacles are concurrently positionable on and over an opposed pair of the patterns of protuberances, and the caps are concurrently positionable on and over another opposed pair of the patterns of protuberances. There is at least one ventilation opening formed in the drying frame within each of the patterns of protuberances to provide drying ventilation.

16 Claims, 5 Drawing Sheets

CONTACT LENS CASE DRYING AND STORAGE RACK ASSEMBLY

FIELD OF THE INVENTION

The present invention relates to contact lens cases and covers and, more particularly, to systems and methods of drying and storing contact lens storage cases.

BACKGROUND OF THE INVENTION

Most contact lens wearers understand the importance of cleaning their contacts or contact lenses on a daily basis. Cleaning and disinfecting contacts on a daily basis extends the life of the contacts and reduces the risk of developing a potentially dangerous eye infection. A contact lens case, which is the "home" of the lenses during periods of nonuse, such as overnight, should be thought of as an extension of the contact lens, and should also be thoroughly cleaned on a regular basis.

Contacts lens cases can be a significant source of microbial contamination. To help prevent eye infections, contact lens cases should be cleaned, rinsed and properly dried every day, particularly after the contacts are removed from the case and placed in the eyes for the day.

Cleaning a contact lens case generally involves removing any solid matter or debris that may have fallen into the case, rinsing each section of the case, including the lids or caps, with the hot water or with same contact lens cleaning solution used to clean and disinfect the contacts. After cleaning, the contact lens case, including the lids or caps, must be thoroughly dried to prevent bacteria formation. Some people dry the sections of the contact lens case by wiping them with a dry cloth, or by placing the contact lens case components upside down on a clean towel. These drying techniques are generally not recommended because they can lead to microbial contamination that can, in turn, lead to painful eye infections. Furthermore, air-drying by simply placing the contact lens case components on a clean towel is often unsatisfactory as the towel does not provide a secure support for the components, which often leads to the contact lens case components falling to the floor or into the sink. Other people close the contact lens wet which does not allow for proper drying, or lay them flat on dirty bathroom counter or sink edge, both of which can lead to microbial contamination. If cases are laid open face up they are also slow to dry and are exposed to contaminants getting in such as dust, hairspray, germs, and the like. If the sections of the case are laid open face down on a flat surface they are substantially isolated from airflow to dry properly, which can also lead to microbial formation. Furthermore, in households where numerous people wear contact lenses, keeping each person's contact lens case components separate after cleaning and drying to prevent mismatching is particularly challenging, especially when they are cleaned at the same time.

SUMMARY OF THE INVENTION

According to the principle of the invention, a drying rack and contact lens storage case assembly includes a drying frame, and a contact lens storage case assembly. The contact lens storage case assembly consists of a base formed with first and second receptacles, and first and second caps relating to the first and second receptacles, respectively. The first and second receptacles are externally threaded, and the first and second caps of internally threaded. The first receptacle has a first inner diameter, and the second receptacle has a second inner diameter equal to the first inner diameter of the first receptacle. The first cap has a third inner diameter, and the second cap has a fourth inner diameter equal to the third inner diameter of the first cap. The third and fourth diameters of the first and second caps are each somewhat larger than each of the first and second diameters of the first and second receptacles, respectively. The drying frame has a lower face and an opposed upper face formed with opposed first and second patterns of protuberances relating to the first and second inner diameters of the first and second receptacles, respectively, and opposed third and fourth patterns of protuberances. The third pattern of protuberances relates to the third inner diameter of the first cap, and the fourth pattern of protuberances relates to the fourth inner diameter of the second cap. The first and second receptacles of the base of the contact lens storage case assembly are concurrently positionable on the first and second patterns of protuberances, the first cap is positionable on the third pattern of protuberances, and the second cap is positionable on the fourth pattern of protuberances, wherein the first pattern of protuberances is to extend into the first receptacle and is to be concurrently received against the first inner diameter of the first receptacle, the second pattern of protuberances is to extend into the second receptacle and is to be concurrently received against the second inner diameter of the second receptacle, the third pattern of protuberances is to extend into the first cap and is to be concurrently received against the third inner diameter of the first cap, and the fourth pattern of protuberances is to extend into the second cap and is to be concurrently received against the fourth inner diameter of the second cap. At least one ventilation opening is formed through the drying frame from the lower face to the upper face within each of the first, second, third, and fourth patterns of protuberances to provide drying ventilation. Supporting feet are formed in the lower face of the drying frame, which may be directed against a support surface to support the drying frame at an elevated location relative to the support surface.

The drying frame has a marginal perimeter edge encircling the first, second, third, and fourth patterns of protuberances. An upstanding support is attached to a length of the marginal perimeter edge. The support projects upward relative to the upper face of the drying frame, and there is identifying indicia carried by the support. In a particular embodiment, the identifying indicia are applied to a plate carried by the support. The plate is a separate and discreet component relative to the support, and is removably coupled to the support in a particular embodiment.

In the installation of the contact lens storage case assembly to the drying frame, the first and second receptacles of the base of the contact lens storage case assembly are concurrently deposited on the first and second patterns of protuberances, the first cap is deposited on the third pattern of protuberances, and the second cap is deposited on the fourth pattern of protuberances, wherein the first pattern of protuberances extends into the first receptacle and is concurrently received against the first inner diameter of the first receptacle, the second pattern of protuberances extends into the second receptacle and is concurrently received against the second inner diameter of the second receptacle, the third pattern of protuberances extends into the first cap and is concurrently received against the third inner diameter of the first cap, and the fourth pattern of protuberances extends into the second cap and is concurrently received against the fourth inner diameter of the second cap. Preferably, there is at least one ventilation opening formed through the drying frame from the lower face to the upper face within each of the first, second, third, and fourth patterns of protuberances providing drying ventilation for the first receptacle, the second receptacle, the first cap, and the second cap, respectively.

In yet a further embodiment, there is a support platform having a lower surface formed with supporting feet and an opposed upper surface formed with recesses arranged to concurrently accept the supporting feet formed in the lower face of the drying frame. The support platform has a marginal perimeter edge encircling the recesses formed in the upper surface of the support platform, an upstanding support is attached to a length of the marginal perimeter edge of the support platform, the support projects upward relative to the upper surface of the support platform, and identifying indicia is carried by the support. Ventilation openings are formed through the support platform from the lower surface to the upper surface to provide drying ventilation.

BRIEF DESCRIPTION OF THE DRAWINGS

Referring to the drawings.

DETAILED DESCRIPTION

Figure 1:
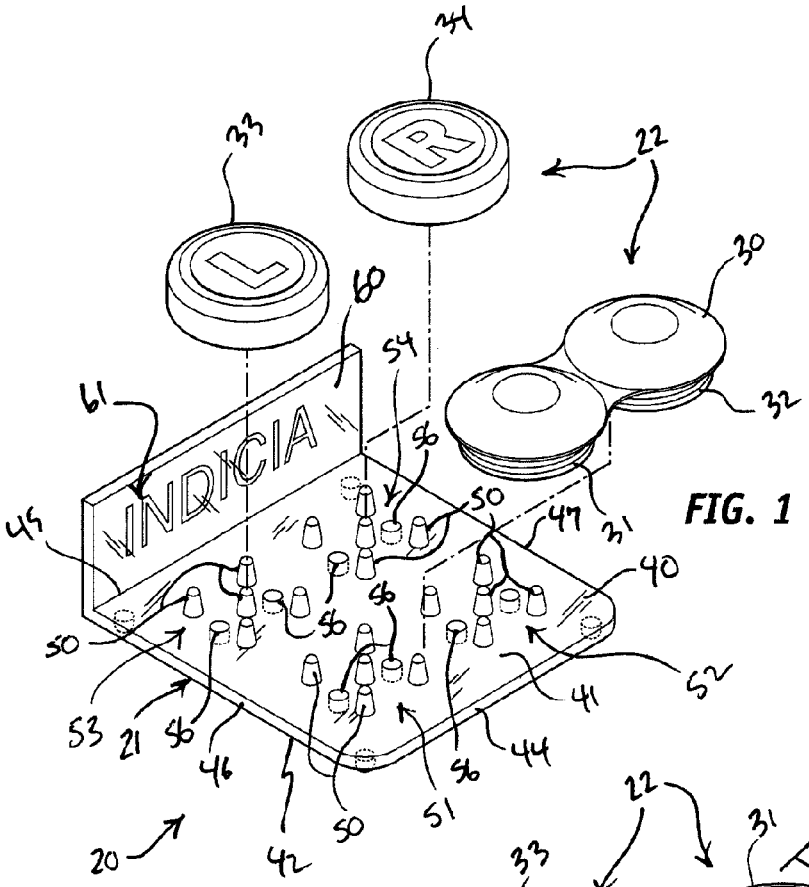
FIG. 1 is a top perspective view of a drying rack and contact lens storage case assembly including a drying frame, and a contact lens storage case assembly shown disassembled and spaced from the drying frame in preparation for installation to drying frame for storage and drying purposes.
Figure 2:
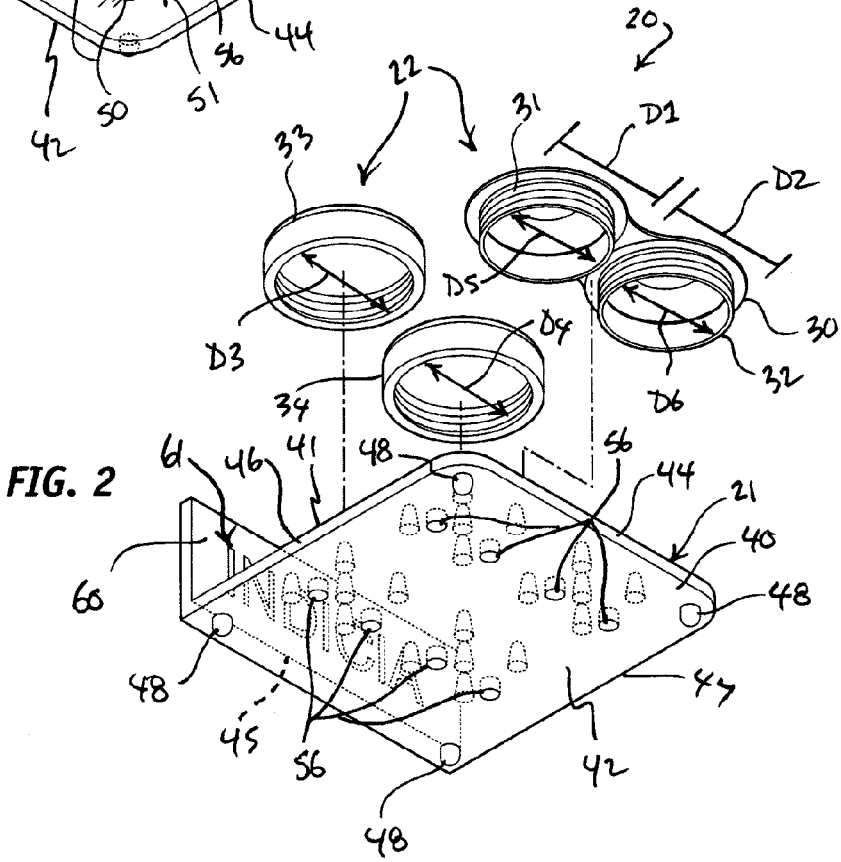
FIG. 2 is a bottom perspective view of the embodiment of FIG. 1.

Turning now to the drawings, in which like reference characters indicate corresponding elements throughout the several views, attention is first directed to FIGS. 1 and 2 illustrating a drying rack and contact lens storage case assembly 20 including a drying frame denoted generally at 21, and a contact lens storage case assembly denoted generally at 22. Contact lens storage case assembly 21 is standard, common, and well known, and consists of a conventionally formed base 30, formed opposed, spaced-apart receptacles 31 and 32, and a pair of conventionally formed lids or caps 33 and 34 relating to receptacles 31 and 32, respectively. Base 30 and caps 33 and 34 are each integrally formed of plastic as is the case with standard contact lens storage case assemblies, such as assembly 22. Receptacles 31 and 32 are externally threaded, and caps 33 and 34 are internally threaded. In particular, receptacles 31 and 32 have outer diameters D1 and D2, respectively, which are externally threaded, and caps 33 and 34 having inner diameters D3 and D4, respectively, which are internally threaded and which encircle the interior volumes of caps 33 and 34, respectively. Receptacles 31 and 32 also have inner diameters D5 and D6 which encircle the interior volumes of receptacles 31 and 32, respectively. Receptacles 31 and 32 are equal in size and shape, outer diameter D1 of receptacle 31 is equal to outer diameter D2 of receptacle 32, and inner diameter D5 of receptacle 31 is equal to inner diameter D6 of receptacle 32. Outer diameters D1 and D2 of receptacles 31 and 32 are somewhat greater or larger than inner diameters D5 and D6 of receptacles 31 and 32, respectively. Caps 33 and 34 are equal in size and shape, and inner diameter D3 of cap 33 is equal to inner diameter D4 of cap 34.

Contact lens storage case assembly 22 is used to keep and store a pair of contact lens during periods of nonuse, such as during the night. In use, receptacles 31 and 32 are each filled with a suitable contact lens solution, left and right contact lens are set into the respective receptacles 31 and 32, and the internally threaded inner diameters D3 and D3 of caps 33 and 34 are tightly threaded onto outer diameters D1 and D2 of receptacles 31 and 32 to enclose and seal the contents of receptacles 31 and 32. The contact lens solution in receptacles 31 and 32 keeps the respective contact lenses moist. To use the contact lens, caps 33 and 34 are removed from receptacles 31 and 32, and the contact lens are removed from receptacles 31 and 32 and applied to the user's eyes. At this point, it is important to thoroughly clean and dry contact lens storage case assembly 22. To clean receptacles 31 and 32 and caps 33 and 34, any solid matter or debris is removed from the respective sections, and the respective sections are thoroughly rinsed with hot water or with a contact lens solution. After this cleaning, the contact lens storage case assembly is thoroughly dried and stored with the use of drying frame 21 until the next use of contact lens storage case assembly 22.

To permit the inner diameters D3 and D4 of caps 33 and 34 to be threaded onto outer diameters D1 and D2 of receptacles 31 and 32, the inner diameters D3 and D4 are somewhat greater or larger than outer diameters D1 and D2 of receptacles 31 and 32, respectively. Because outer diameters D1 and D2 of receptacles 31 and 32 are somewhat greater or larger than inner diameters D5 and D6 of receptacles 31 and 32, inner diameters D3 and D4 of caps 33 and 34 are somewhat greater or larger than inner diameters D5 and D6 of receptacles 31 and 32, respectively.

Set forth for the purpose of orientation and reference, contact lens storage case assembly 22 is generally representative of a standard-sized and conventional contact lens storage case assembly. Accordingly, further details of contact lens storage case assembly 22 are well known to the skilled artisan and will not be discussed in further detail.

Figure 3:
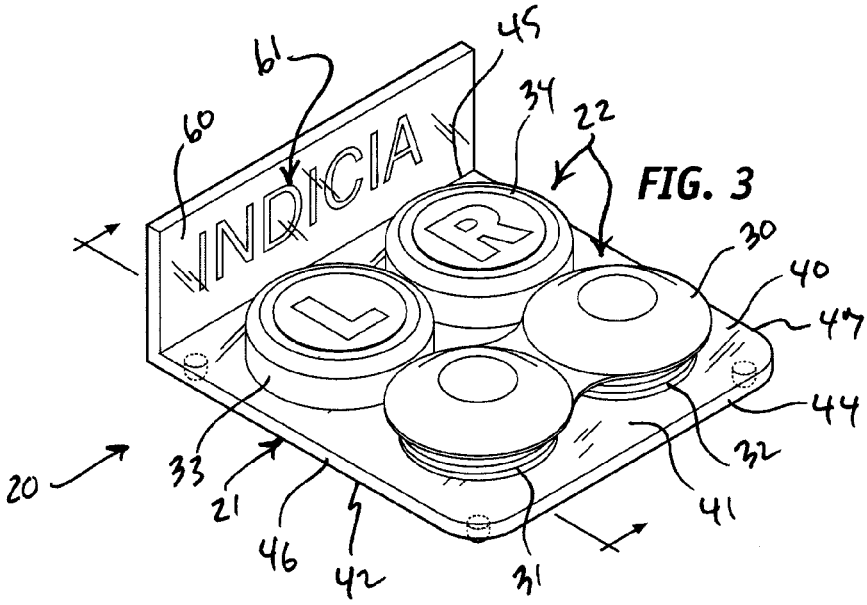
FIG. 3 is a view similar to that of FIG. 1 illustrating the contact lens storage case assembly as it would appear installed with respect to the drying frame.
Figure 4:
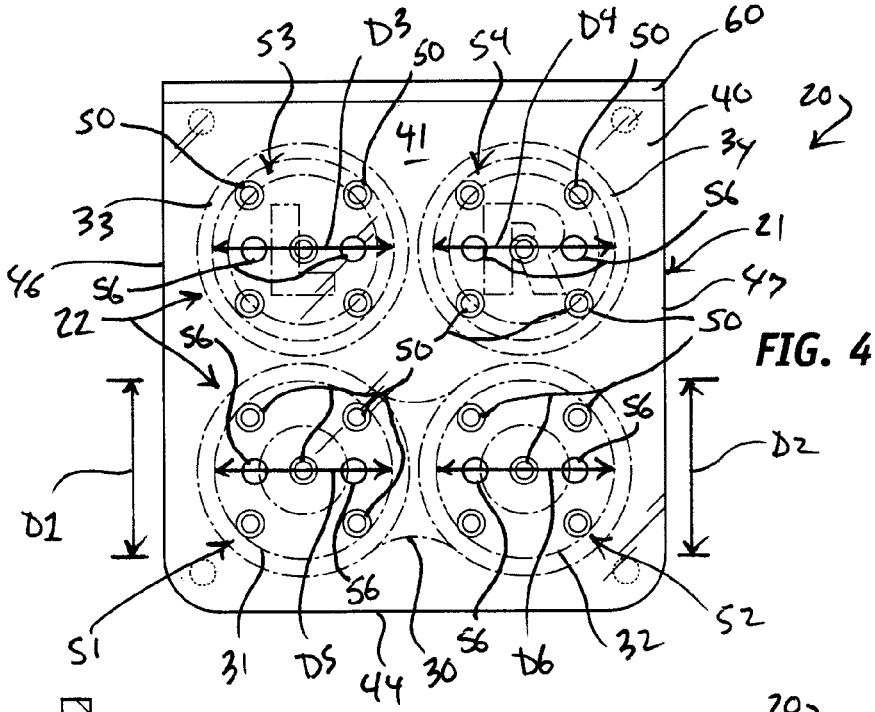
FIG. 4 is as top plan view of the embodiment of FIG. 3 depicting the contact lens storage case assembly in phantom outline for illustrative purposes.

According to the principle of the invention, and with reference in relevant part to FIGS. 1-5, drying frame 21 is preferably formed of plastic or other strong, resilient material or combination of materials, is preferably integrally formed, such as through molding or machining, and consists of a broad, flat body 40 that is generally square in shape and which has opposed, parallel upper and lower faces 41 and 42, and a marginal perimeter extremity or edge formed by opposed, parallel front and rear end edges 44 and 45 having substantially equal lengths, and opposed parallel side edges 46 and 47 extending therebetween, and which also have substantially equal lengths. Upper face 41 is formed with upstanding hubs or protuberances 50, and lower face 42 is formed with spaced apart supporting feet 48 illustrated in FIG. 2, which may be directed against a support surface to support drying frame 21 at an elevated location relative to the support surface. Protuberances 50 are substantially equal in size and shape, and project upward from upper face 41. According to the principle of the invention, protuberances are arranged in discrete clusters or patterns 51, 52, 53, and 54. In the present embodiment, there are twenty protuberances 50, and patterns 51, 52, 53, and 54 each have five of the twenty protuberances, which are equidistantly spaced apart and include one protuberance 50 encircled by a pattern of four protuberances 50 as best shown in FIGS. 1 and 4. Patterns 51, 52, 53, and 54 of protuberances 50 are formed within the perimeter edge of body 40, such that the marginal perimeter edge of body 40 encircles patterns 51, 52, 53, and 54 of protuberances. Ventilation openings 56 are formed through body 40 of drying frame 21 from lower face 42 to upper face 41 within each of the patterns 51-54 of protuberances to provide drying ventilation at patterns 51-54 of protuberances 50. In the present embodiment, patterns 51-54 of protuberances 50 are each associated with two ventilation openings 56, and less or more ventilation openings 56 may be incorporated in conjunction with each of patterns 51-54 if so desired.

Patterns 51 and 52 of protuberances 50 are spaced apart, and are formed proximate to front edge 44 of body 40 between side edges 46 and 46 of body 40. Patterns 53 and 54 of protuberances 50 are generally parallel with respect to patterns 51 and 52 of protuberances 50. Patterns 53 and 54 of protuberances 50 are spaced apart, and are formed proximate to rear edge 45 of body 40 between side edges 46 and 47 of body 50. According to the principle of the invention, patterns 51 and 52 of protuberances 50 relate to receptacles 31 and 32, respectively, formed in base 30, and patterns 53 and 54 of protuberances 50 relate to caps 33 and 34, respectively. In a further and more specific aspect, patterns 51 and 52 of protuberances 50 relate to and are able to be received by inner diameters D5 and D6 of receptacles 31 and 32, respectively, and patterns 53 and 54 of protuberances relate to and are able to be received by inner diameters D3 and D4 of caps 33 and 34.

For storage and drying purposes, drying frame 21 is set onto a support surface, such as a counter, by directing feet 48 against the support surface such that upper face 41 directed upwardly orienting drying frame 21 for use in receiving and holding base 30 and caps 33 and 34 for storage and drying purposes, such as after cleaning and rinsing. Receptacles 31 and 32 of base 30 are concurrently positionable over and on patterns 51 and 52 of protuberances 50, cap 33 is positionable over and on pattern 53 of protuberances 50, and cap 34 is positionable over and on pattern 54 of protuberances 50. The installation of base 30 and caps 33 and 34 to drying frame 21 is shown in FIG. 3 and also FIG. 4. For illustrative purpose, base 30 and caps 33 and 34 of FIG. 4 are depicted in phantom outline to illustrate the relationship between patterns 51-54 of protuberances 50 and the corresponding inner diameters of receptacles 31 and 32 of base 30, and caps 33 and 34.

Figure 5:
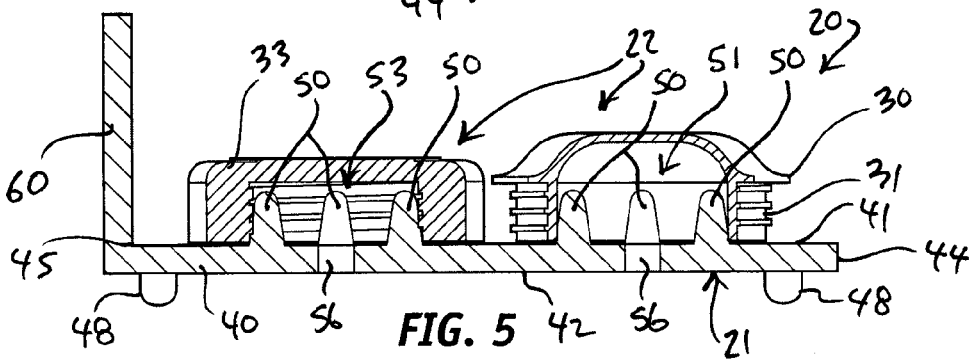
FIG. 5 is a section view taken along line 5-5 of FIG. 3.

With respect to the installation of base 30 to drying frame 21, pattern 51 of protuberances 50 is to extend into the interior volume of receptacle 31 as shown in FIG. 5 and the pattern of four protuberances 50 encircling the fifth protuberance 50 of pattern 51 are positioned and spaced relative to each other to concurrently relate to inner diameter D5 and is to be received against inner diameter D5 of receptacle 31 as illustrated in FIG. 4 to hold and secure receptacle 31 for storage and drying purposes, and identically pattern 52 of protuberances 50 is to extend into the interior volume of receptacle 32 and the pattern of four protuberances 50 encircling the fifth protuberance 50 of pattern 52 are positioned and spaced relative to each other to concurrently relate to inner diameter D6 and is to be received against inner diameter D6 of receptacle 32 as seen in FIG. 4 to hold and secure receptacle 32 for storage and drying purposes. With respect to the installation of caps 33 and 34 to drying frame 21, pattern 53 of protuberances 50 is to extend into the interior volume of cap 33 as shown in FIG. 5 and the pattern of four protuberances 50 encircling the fifth protuberance 50 of pattern 53 are positioned and spaced relative to each other to concurrently relate to inner diameter D3 and is to be received against inner diameter D3 of cap 33 as seen in FIG. 4 to hold and secure cap 33 for storage and drying purposes, and identically pattern 54 of protuberances 50 is to extend into the interior volume of cap 34 and the pattern of four protuberances 50 encircling the fifth protuberance 50 of pattern 54 are positioned and spaced relative to each other to concurrently relate to inner diameter D4 and is to be received against inner diameter D4 of cap 34 as shown in FIG. 4 to hold and secure cap 34 for storage and drying purposes.

To install base 30 to drying frame 21 for storage and drying purposes, base 30 is inverted over patterns 51 and 52 of protuberances 50 as seen in FIG. 1 registering receptacles 31 and 32 with patterns 51 and 52 of protuberances and base 30 is presented downwardly onto upper face 41 of body 40 applying pattern 51 of protuberances 50 into the interior volume of receptacle 31 as shown in FIG. 5 and the four protuberances 50, which is a pattern of protuberances, encircling the fifth protuberance 50 of pattern of pattern 51 are concurrently received against inner diameter D5 of receptacle 31 as illustrated in FIG. 4 to hold and secure receptacle 31 for storage and drying purposes, and identically pattern 52 of protuberances 50 is concurrently applied into the interior volume of receptacle 32 and the four protuberances 50, which is a pattern of protuberances, encircling the fifth protuberance 50 of pattern of pattern 52 are concurrently received against inner diameter D6 of receptacle 32 as seen in FIG. 4 to hold and secure receptacle 32 for storage and drying purposes. This application of receptacles 31 and 32 of base 30 over and onto patterns 51 and 52 of protuberances 50 installs base 30 to drying frame 21 for storage and drying purposes, and ventilation openings 56 formed in patterns 51 and 52 provide drying ventilation for receptacles 31 and 32 of base 30.

To install cap 33 to drying frame 21, cap 33 is inverted over pattern 53 of protuberances 50 as seen in FIG. 1 registering cap 33 with pattern 53 of protuberances and cap 33 is presented downwardly onto upper face 41 of body 40 applying pattern 53 of protuberances 50 into the interior volume of cap 33 as shown in FIG. 5 and the four protuberances 50, which is a pattern of protuberances, encircling the fifth protuberance 50 of pattern 53 are concurrently received against inner diameter D3 of cap 33 as illustrated in FIG. 4 to hold and secure cap 33 for storage and drying purposes. This application of cap 33 over and onto pattern 53 of protuberances 50 installs cap 33 to drying frame 21 for storage and drying purposes, and ventilation openings 56 formed in pattern 53 provide drying ventilation for cap 33. To install cap 34 to drying frame 21, cap 34 is inverted over pattern 54 of protuberances 50 as seen in FIG. 1 registering cap 34 with pattern 54 of protuberances and cap 34 is presented downwardly onto upper face 41 of body 40 applying pattern 54 of protuberances 50 into the interior volume of cap 34 and the four protuberances 50, which is a pattern of protuberances, encircling the fifth protuberance 50 of pattern of pattern 54 are concurrently received against inner diameter D4 of cap 34 as illustrated in FIG. 4 to hold and secure cap 34 for storage and drying purposes. This application of cap 34 over and onto pattern 54 of protuberances 50 installs cap 34 to drying frame 21 for storage and drying purposes, and ventilation openings 56 formed in pattern 54 provide drying ventilation for cap 34. The spacing of patterns 51-54 of protuberances 50 permits base 30 and caps 33 and 34 to be concurrently applied to body 40 of drying frame 21 for storage and drying purposes. To remove base 30 and caps 33 and 34 from drying frame 21, each need only be taken up, such as by hand, and lifted away from upper face 41 of drying frame 21.

To distinguish and identify drying frame 21 as relating to particular user to prevent or otherwise inhibit unauthorized use of drying frame 21, drying frame 21 is formed with an upstanding support 60. Support 60 is attached to a length of the marginal perimeter edge of body 40, which, in this instance, is the length of rear edge 45 of body 40. In the present embodiment, support 60 is integrally formed with body 40, and projects upright from rear edge 45 relative to upper face 41 of body 40. Indicia 61 applied to support 60 consists of distinguishing markings, signs, or indications, which are designed to distinguish and identify drying frame 21 as relating to a particular user to prevent unauthorized use of drying frame 21 and to prevent unauthorized or unintended use of a contact lens storage case assembly installed onto drying frame 21 for storage and drying purposes. Indicia 61 can be a name, a word, a sign, a symbol, a color, a series of colors, or the like to provide the desired identification to prevent unauthorized or unintended use of drying frame 21 and/or a contact lens storage case assembly installed on drying frame 21.

Figures 6, 7, 8:
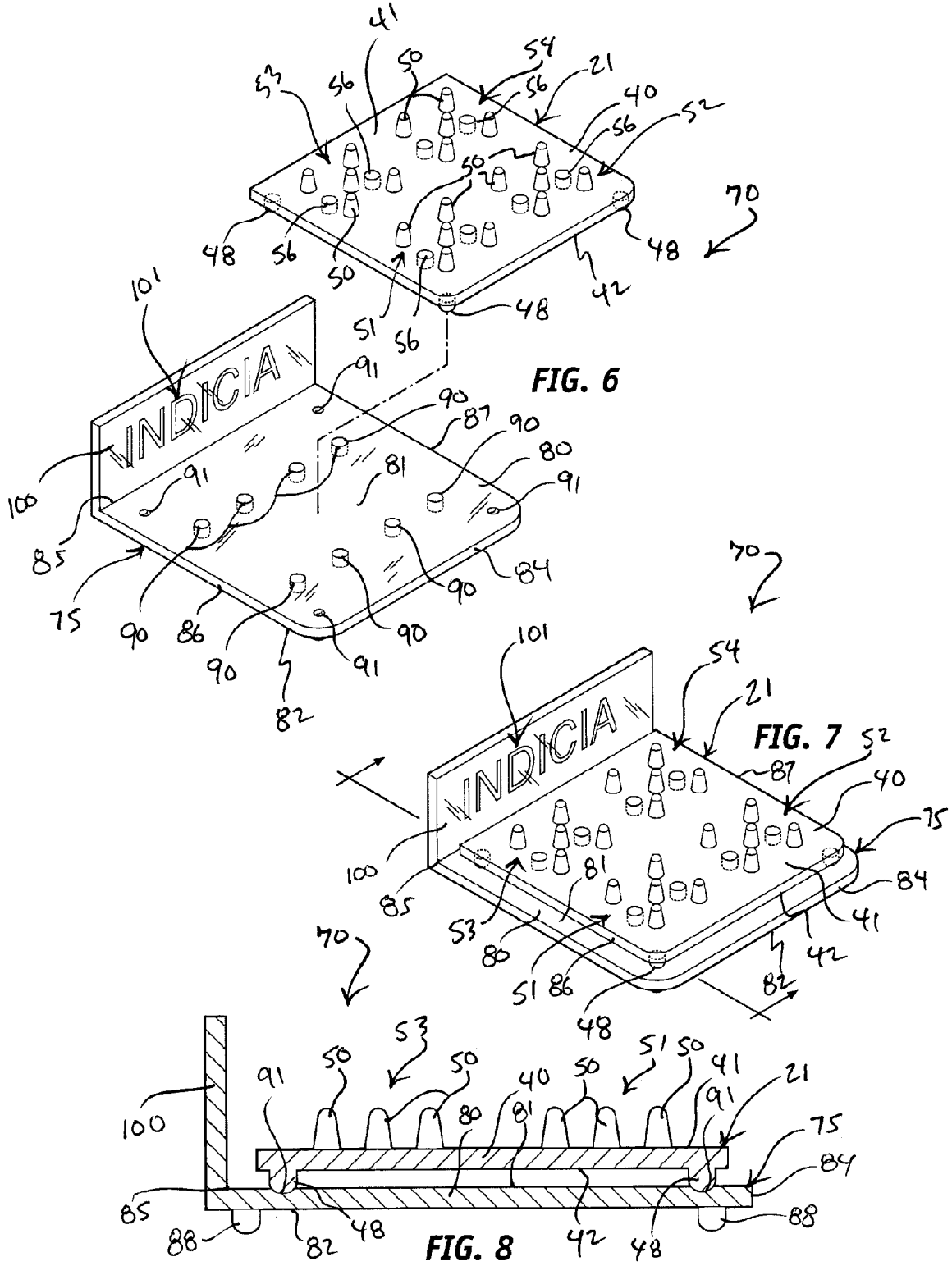
FIG. 6 is an exploded perspective view of an alternate embodiment of a drying rack assembly for a contact lens storage case assembly.
FIG. 7 is a view similar to that of FIG. 6 illustrating the drying rack assembly as it would appear assembled.
FIG. 8 is a section view taken along line 8-8 of FIG. 7.

FIG. 6 is an exploded perspective view of an alternate embodiment of a drying rack assembly 70 for a contact lens storage case assembly, such as contact lens storage case assembly 22. In common with assembly 20, assembly 70 shares drying frame 21, including base 40 formed with supporting feet 48 formed in lower face 42, patterns 51-54 of protuberances 50 formed in upper face 41, and ventilation openings 56. In assembly 70 there is a support platform 75. Support platform 75 is preferably formed of plastic or other strong, resilient material or combination of materials, is preferably integrally formed, such as through molding or machining, and consists of a broad, flat body 80 that is larger than body 40 discussed above and that is generally square in shape and which has opposed, parallel upper and lower faces 81 and 82, and a marginal perimeter extremity or edge formed by opposed, parallel front and rear end edges 84 and 85 having substantially equal lengths, and opposed parallel side edges 86 and 87 extending therebetween, and which also have substantially equal lengths. Upper face 81 is formed with recesses 90 arranged to concurrently accept supporting feet 48 formed in the lower face of drying frame 21 as substantially shown in FIGS. 78 and 8 to provide a convenient holder for drying frame 21, and lower face 82 is formed with spaced apart supporting feet 88 (FIG. 8), which may be directed against a support surface to support drying frame 21 at an elevated location relative to the support surface. Ventilation openings 90 are formed through body 80 of support platform 75 from lower face 82 to upper face 81 to provide drying ventilation for drying frame 21 set onto body 80 as illustrated in FIGS. 7 and 8. In the present embodiment there are eight ventilation openings 90 formed in body 80, and less or more may be provided if so desired.

To distinguish and identify support platform 75 of assembly 70, including drying frame 21 installed on support platform 75 and a contact lens storage case assembly installed on drying frame 21, as relating to particular user to prevent or otherwise inhibit unauthorized use of assembly 70, support platform 75 is formed with an upstanding support 100. Support 100 is attached to a length of the marginal perimeter edge of body 80, which, in this instance, is the length of rear edge 85 of body 80. In the present embodiment, support 100 is integrally formed with body 80, and projects upright from rear edge 85 relative to upper face 81 of body 80. Indicia 101 applied to support 100 consists of distinguishing markings, signs, or indications, which are designed to distinguish and identify support platform 75 as relating to a particular user to prevent unauthorized or unintended use of assembly 70, including support platform 75, drying frame 21 installed on support platform 75, and a contact lens storage case assembly installed on drying frame 21 for storage and drying purposes. Indicia 101 can be a name, a word, a sign, a symbol, a color, a series of colors, or the like to provide the desired identification to prevent the unauthorized or unintended use as described above.

Figure 9:
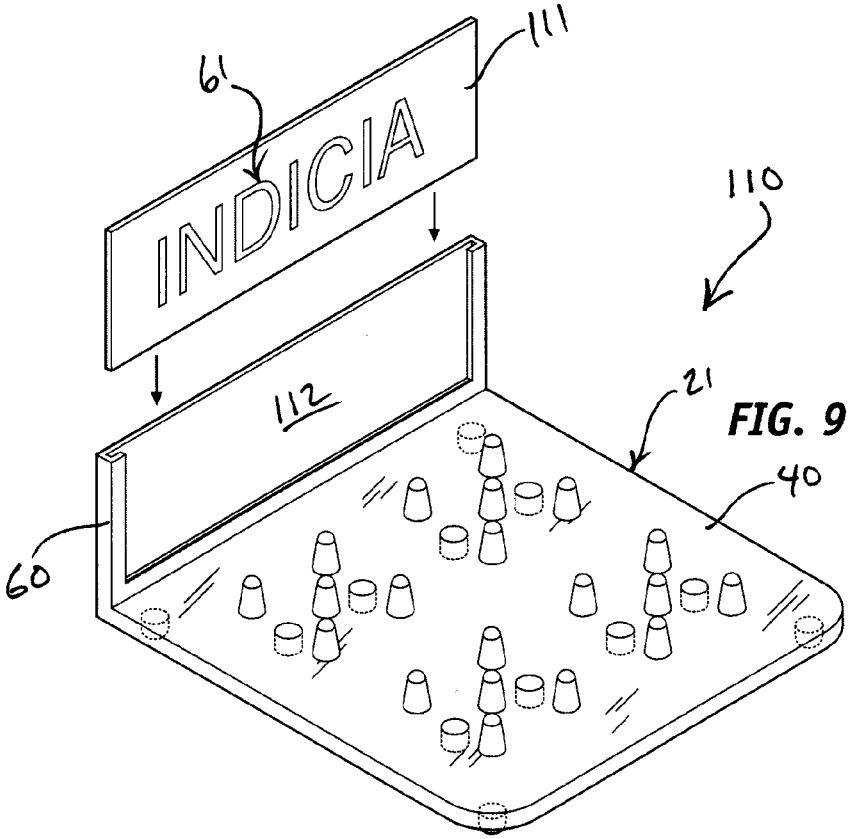
FIG. 9 is an exploded perspective view of yet another alternate embodiment of a drying rack assembly for a contact lens storage case assembly.
Figure 10:
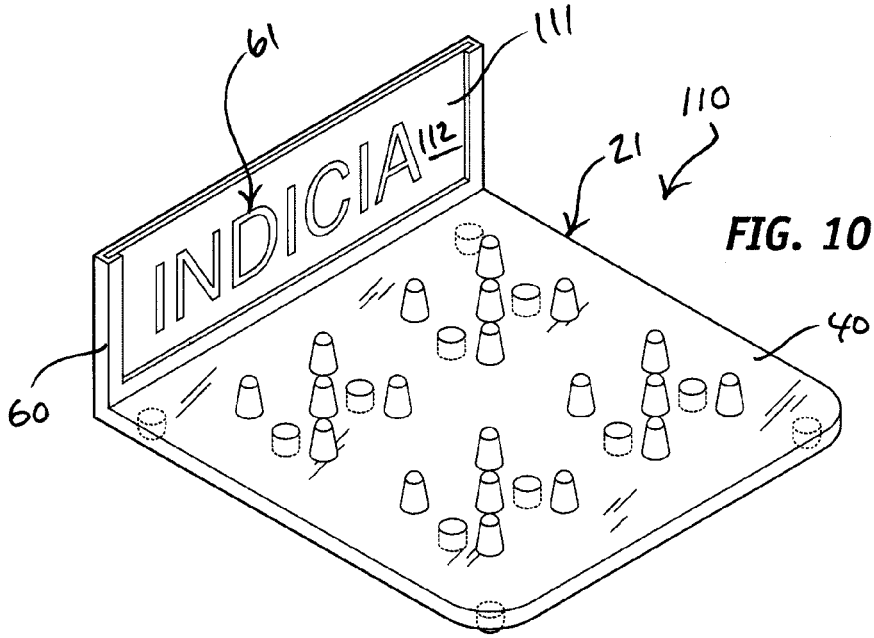
FIG. 10 is a view similar to that of FIG. 9 illustrating the drying rack assembly as it would appear assembled.

Attention is now directed to FIGS. 9 and 10 illustrating yet another embodiment of a drying rack assembly 110 for a contact lens storage case assembly. In common with assembly 70, assembly 110 shares drying frame 21 including body 40 and all related components, support 60, and indicia 61. In assembly 110, indicia 61 is carried by or otherwise formed in a plate 111, which is formed of metal, plastic, or the like. In assembly 110, indicia 61 are applied to plate 111, which is carried by support 60 as shown in FIG. 10. Plate 111 is a separate and discreet component relative to support 60, and is removably coupled to support 60 and is, moreover, movable between a first position detached from support 60 as shown in FIG. 9, and a second position attached to and thus carried by support 60 as shown in FIG. 10. In the present embodiment, support 60 is formed with a sleeve 112 to accept and hold plate 112 as illustrated in FIG. 10. The instruction provided by assembly 110 is to demonstrate indicia 61 carried by a plate 111 removably couplable to support 60, which allows plate 111 and indicia 61 carried thereby to be removed for cleaning or replacement as may be required.

Figure 11:
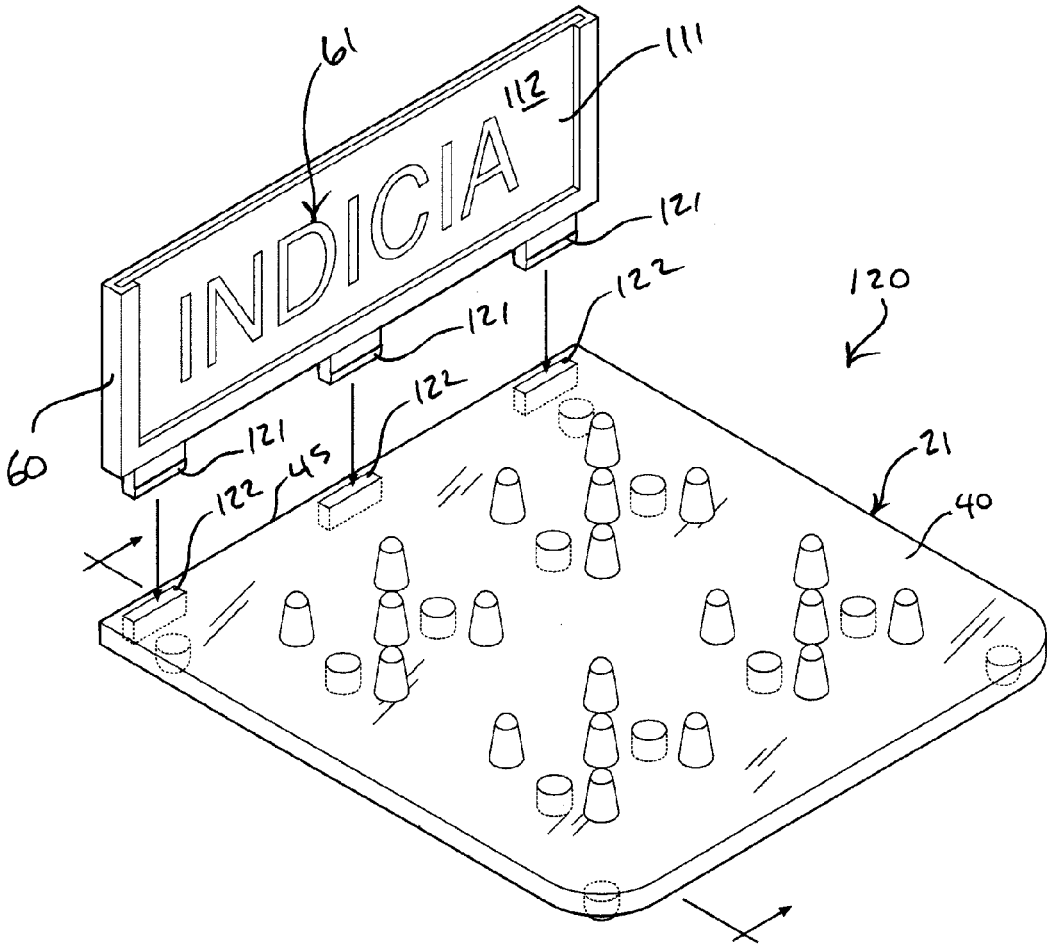
FIG. 11 is a partially exploded perspective view of a further another alternate embodiment of a drying rack assembly for a contact lens storage case assembly.
Figure 12:
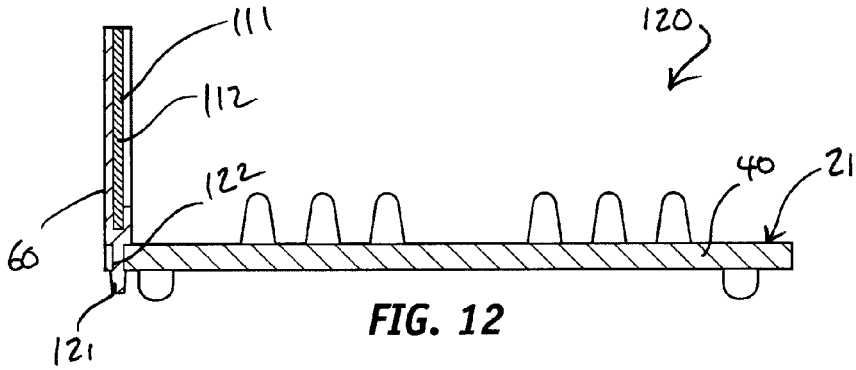
FIG. 12 is a section view taken along line 11-11 of FIG. 12 illustrating the drying rack assembly as it would appear assembled.

In assembly 110 shown in FIGS. 9 and 10, support 60 is integrally formed with base 40. If desired, support 60 may be removably attached to base 40 in an alternate embodiment of a drying rack assembly 120 for a contact lens storage case assembly as shown in FIGS. 11 and 12. In common with assembly 110, assembly 111 shares drying frame 21 including body 40 and all related components, support 60, and indicia 61 carried by plate 111 removably applied to sleeve 112 formed in support 60. In assembly 111, support 60 is a separate and discrete component with respect to body 40, and is removably couplable or otherwise engagable to body 40 with an engagement assembly including elements 121 thereof formed in support 60 which are detachably engagable to corresponding complemental or complementing elements thereof formed in body 40 along rear edge 45. In the present embodiment, elements 121 are male engagement elements or tabs that relate to and are removably received by corresponding slots formed in body 40 forming the corresponding complemental or complementing engagement elements of the engagement assembly formed between support 60 and body 40. FIG. 11 illustrates support 60 as it would appear detached from body 40, and FIG. 12 is a section view illustrating support 60 as it would appear coupled to body 40, and further illustrating a tab forming one of the engagement elements 121 as it would appear received into and through one of a corresponding slot forming one of the corresponding complemental or complementing engagement elements. Although elements 121 are carried by body 60 and corresponding complemental or complementing elements 122 are carried by body 40, this arrangement can be reversed or mixed and matched as may be desired. Furthermore, other engagement assemblies suitable to provide a removable or releasable attachment of support 60 to body 40 can be used without departing from the invention.

The present invention is described above with reference to preferred embodiments. However, those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A drying rack and contact lens storage case assembly, comprising:

a contact lens storage case assembly, including:

an integral base formed with an externally threaded first receptacle having a first inner diameter, and an opposed externally threaded second receptacle having a second inner diameter equal to the first inner diameter of the first receptacle; and internally threaded first and second caps relating to the first and second receptacles, respectively, the first cap having a third inner diameter, the second cap having a fourth inner diameter equal to the third inner diameter of the first cap, and the third and fourth diameters of the first and second caps each being somewhat larger than each of the first and second diameters of the first and second receptacles, respectively;

a frame having a lower face and an opposed upper face formed with opposed first and second patterns of protuberances relating to the first and second inner diameters of the first and second receptacles, respectively, and opposed third and fourth patterns of protuberances, the third pattern of protuberances relating to the third inner diameter of the first cap, and the fourth pattern of protuberances relating to the fourth inner diameter of the second cap;

the first and second receptacles of the base of the contact lens storage case assembly concurrently positionable on the first and second patterns of protuberances, the first cap positionable on the third pattern of protuberances, and the second cap positionable on the fourth pattern of protuberances; wherein:

the first pattern of protuberances to extend into the first receptacle and to be concurrently received against the first inner diameter of the first receptacle;

the second pattern of protuberances to extend into the second receptacle and to be concurrently received against the second inner diameter of the second receptacle;

the third pattern of protuberances to extend into the first cap and to be concurrently received against the third inner diameter of the first cap;

the fourth pattern of protuberances to extend into the second cap and to be concurrently received against the fourth inner diameter of the second cap; and at least one ventilation opening formed through the frame from the lower face to the upper face within each of the first, second, third, and fourth patterns of protuberances to provide drying ventilation.

2. A drying rack and contact lens storage case assembly according to claim 1, further comprising supporting feet formed in the lower face of the frame.

3. A drying rack and contact lens storage case assembly according to claim 2, further comprising:

the frame having a marginal perimeter edge encircling the first, second, third, and fourth patterns of protuberances;

an upstanding support attached to a length of the marginal perimeter edge;

the support projecting upward relative to the upper face of the frame; and identifying indicia carried by the support.

4. A drying rack and contact lens storage case assembly according to claim 3, wherein the identifying indicia is applied to a plate carried by the support.

5. A drying rack and contact lens storage case assembly according to claim 4, wherein the plate is a separate and discreet component relative to the support, and is removably coupled to the support.

6. A drying rack and contact lens storage case assembly according to claim 2, further comprising a support platform having a lower surface formed with supporting feet and an opposed upper surface formed with recesses arranged to concurrently accept the supporting feet formed in the lower face of the frame.

7. A drying rack and contact lens storage case assembly according to claim 6, further comprising:

the support platform having a marginal perimeter edge encircling the recesses formed in the upper surface of the support platform;

an upstanding support attached to a length of the marginal perimeter edge of the support platform;

the support projecting upward relative to the upper surface of the support platform; and identifying indicia carried by the support.

8. A drying rack and contact lens storage case assembly according to claim 7, further comprising ventilation openings formed through the support platform from the lower surface to the upper surface to provide drying ventilation.

9. A drying rack and contact lens storage case assembly, comprising:

a contact lens storage case assembly, including:

an integral base formed with an externally threaded first receptacle having a first inner diameter, and an opposed externally threaded second receptacle having a second inner diameter equal to the first inner diameter of the first receptacle; and internally threaded first and second caps relating to the first and second receptacles, respectively, the first cap having a third inner diameter, the second cap having a fourth inner diameter equal to the third inner diameter of the first cap, and the third and fourth diameters of the first and second caps each being somewhat larger than each of the first and second diameters of the first and second receptacles, respectively;

a frame having a lower face and an opposed upper face formed with opposed first and second patterns of protuberances relating to the first and second inner diameters of the first and second receptacles, respectively, and opposed third and fourth patterns of protuberances, the third pattern of protuberances relating to the third inner diameter of the first cap, and the fourth pattern of protuberances relating to the fourth inner diameter of the second cap;

the first and second receptacles of the base of the contact lens storage case assembly concurrently deposited on the first and second patterns of protuberances, the first cap deposited on the third pattern of protuberances, and the second cap deposited on the fourth pattern of protuberances;

the first pattern of protuberances extending into the first receptacle and concurrently received against the first inner diameter of the first receptacle;

the second pattern of protuberances extending into the second receptacle and concurrently received against the second inner diameter of the second receptacle;

the third pattern of protuberances extending into the first cap and concurrently received against the third inner diameter of the first cap;

the fourth pattern of protuberances extending into the second cap and concurrently received against the fourth inner diameter of the second cap; and at least one ventilation opening formed through the frame from the lower face to the upper face within each of the first, second, third, and fourth patterns of protuberances providing drying ventilation for the first receptacle, the second receptacle, the first cap, and the second cap, respectively.

10. A drying rack and contact lens storage case assembly according to claim 9, further comprising supporting feet formed in the lower face of the frame.

11. A drying rack and contact lens storage case assembly according to claim 10, further comprising:

the frame having a marginal perimeter edge encircling the first, second, third, and fourth patterns of protuberances;

an upstanding support attached to a length of the marginal perimeter edge;

the support projecting upward relative to the upper face of the frame; and identifying indicia carried by the support.

12. A drying rack and contact lens storage case assembly according to claim 11, wherein the identifying indicia is applied to a plate carried by the support.

13. A drying rack and contact lens storage case assembly according to claim 12, wherein the plate is a separate and discreet component relative to the support, and is removably coupled to the support.

14. A drying rack and contact lens storage case assembly according to claim 10, further comprising a support platform having a lower surface formed with supporting feet and an opposed upper surface formed with recesses arranged to concurrently accept the supporting feet formed in the lower face of the frame.

15. A drying rack and contact lens storage case assembly according to claim 14, further comprising:

the support platform having a marginal perimeter edge encircling the recesses formed in the upper surface of the support platform;

an upstanding support attached to a length of the marginal perimeter edge of the support platform;

the support projecting upward relative to the upper surface of the support platform; and identifying indicia carried by the support.

16. A drying rack and contact lens storage case assembly according to claim 15, further comprising ventilation openings formed through the support platform from the lower surface to the upper surface to provide drying ventilation.

* * * * *